US011879205B2

(12) United States Patent
Oda et al.

(10) Patent No.: US 11,879,205 B2
(45) Date of Patent: Jan. 23, 2024

(54) TREATMENT AGENT FOR CARBON FIBER PRECURSOR, AQUEOUS SOLUTION OF TREATMENT AGENT FOR CARBON FIBER PRECURSOR, CARBON FIBER PRECURSOR, AND METHOD FOR PRODUCING CARBON FIBERS

(71) Applicant: TAKEMOTO YUSHI KABUSHIKI KAISHA, Gamagori (JP)

(72) Inventors: Kohei Oda, Gamagori (JP); Hiroki Honda, Gamagori (JP)

(73) Assignee: TAKEMOTO YUSHI KABUSHIKI KAISHA, Gamagori (JP)

( * ) Notice: Subject to any disclaimer, the term of this patent is extended or adjusted under 35 U.S.C. 154(b) by 0 days.

(21) Appl. No.: 17/905,118

(22) PCT Filed: Jun. 2, 2021

(86) PCT No.: PCT/JP2021/020983
§ 371 (c)(1),
(2) Date: Aug. 26, 2022

(87) PCT Pub. No.: WO2021/251236
PCT Pub. Date: Dec. 16, 2021

(65) Prior Publication Data

US 2023/0117305 A1 Apr. 20, 2023

(30) Foreign Application Priority Data

Jun. 9, 2020 (JP) ..... 2020-100185

(51) Int. Cl.
*D06M 13/252* (2006.01)
*D01F 9/21* (2006.01)
(Continued)

(52) U.S. Cl.
CPC ..... *D06M 13/252* (2013.01); *D01F 9/21* (2013.01); *D06M 15/6436* (2013.01); *D06M 2101/26* (2013.01); *D06M 2200/40* (2013.01)

(58) Field of Classification Search
CPC ..... D06M 13/252; D06M 15/6436; D06M 2101/26; D06M 2200/40; D01F 9/21
(Continued)

(56) References Cited

U.S. PATENT DOCUMENTS 10,370,791 B2 * 8/2019 Hotta ..... D06M 13/453
2008/0118427 A1 * 5/2008 Leon y Leon ..... D01F 9/32 423/447.2
2014/0045738 A1 * 2/2014 Tatsumi ..... C10M 135/26 508/497

FOREIGN PATENT DOCUMENTS

JP 59-116472 * 7/1984 ..... D06M 13/28
JP 59116472 A 7/1984
(Continued)

OTHER PUBLICATIONS

Machine Translation of JP 59-116472 to Fujii, et al. (Year: 1984).*
(Continued)

*Primary Examiner* — Daniel C. McCracken
(74) *Attorney, Agent, or Firm* — CANTOR COLBURN LLP

(57) ABSTRACT

The present invention addresses the problem of suitably improving a treatment agent for a carbon fiber precursor in terms of the heat resistance and the effect of suppressing fusion between fibers during the step of flame-resisting treatment. This treatment agent for a carbon fiber precursor is characterized by containing a lubricant, the lubricant comprising a specific sulfur-containing diester compound and a specific sulfur-containing monoester compound.

12 Claims, 1 Drawing Sheet

(51) Int. Cl.
*D06M 15/643* (2006.01)
*D06M 101/26* (2006.01)

(58) Field of Classification Search
USPC ..... 423/447.1–447.9
See application file for complete search history.

(56) References Cited

FOREIGN PATENT DOCUMENTS

| | | | | | |
|---|---|---|---|---|---|
| JP | 2010121098 | A | | 6/2010 | |
| WO | 2014050639 | A1 | | 4/2014 | |
| WO | WO 2016/125577 | | * | 8/2016 | ..... D06M 13/224 |

OTHER PUBLICATIONS

International Search Report for Application No. PCT/JP2021/020983 dated Jul. 27, 2021.

* cited by examiner

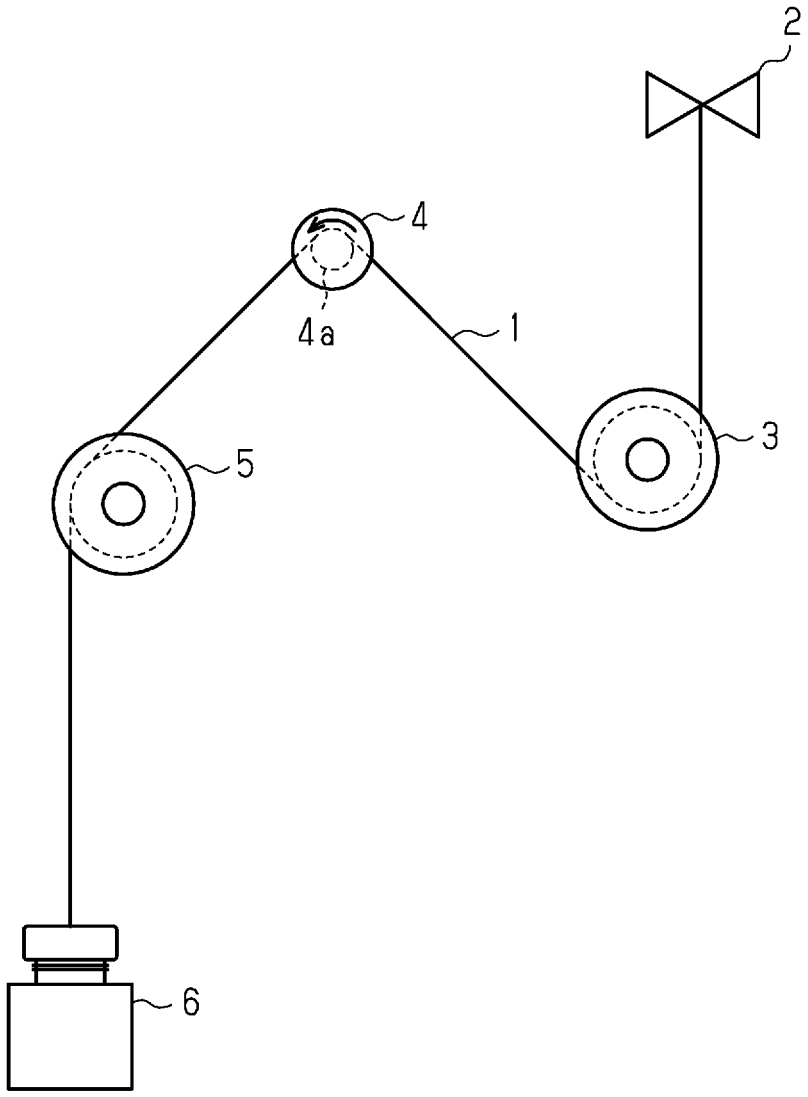
2
4
4a
1
3
5
6

TREATMENT AGENT FOR CARBON FIBER PRECURSOR, AQUEOUS SOLUTION OF TREATMENT AGENT FOR CARBON FIBER PRECURSOR, CARBON FIBER PRECURSOR, AND METHOD FOR PRODUCING CARBON FIBERS

TECHNICAL FIELD

The present invention relates to a carbon fiber precursor treatment agent, an aqueous liquid of a carbon fiber precursor treatment agent, a carbon fiber precursor, and a method for producing a carbon fiber.

BACKGROUND ART

Carbon fibers are produced, for example, by performing a spinning step of spinning an acrylic resin, etc., into fibers, a dry densification step of drying and densifying the spun fibers, a drawing step of drawing the dry densified fibers to produce a carbon fiber precursor, a flame-resisting treatment step of making the carbon fiber precursor flame-resistant, and a carbonization step of carbonizing the flame-resistant fibers.

A carbon fiber precursor treatment agent is used at times on the carbon fiber precursor to suppress fusion between fibers in the flame-resisting treatment step.

A sulfur-containing diester compound having two independent hydrocarbon groups with 12 to 16 carbon atoms is disclosed as a carbon fiber precursor treatment agent in Patent Document 1.

PRIOR ART LITERATURE

Patent Literature

Patent Document 1: International Publication No. WO 2014/050639

SUMMARY OF THE INVENTION

Problems That the Invention is to Solve

Incidentally, further performance improvement of a carbon fiber precursor treatment agent is being sought in terms of an effect of suppressing fusion (also referred to hereinafter as fusion suppression effect) between fibers in a flame-resisting treatment step of a carbon fiber precursor and in terms of heat resistance.

The present invention has been made in view of such circumstances and an object thereof is to provide a carbon fiber precursor treatment agent that is suitably improved in terms of a fusion suppression effect between fibers in a flame-resisting treatment step of a carbon fiber precursor and in terms of heat resistance. It is also an object of the present invention to provide an aqueous liquid of this carbon fiber precursor treatment agent, a carbon fiber precursor to which this carbon fiber precursor treatment agent is adhered, and a method for producing carbon fibers that uses this carbon fiber precursor treatment agent.

Means for Solving the Problems

A carbon fiber precursor treatment agent for solving the above problem in gist is a carbon fiber treatment agent that contains a lubricant, wherein the lubricant contains a sulfur-containing diester compound represented by Chemical Formula 1 shown below.

$$R^1\text{—OOC—}(CH_2)_a\text{—S—}(CH_2)_b\text{—COO—}R^2 \quad \text{[Chemical Formula 1]}$$

(In Chemical Formula 1, a and b are each an integer from 1 to 10 and $R^1$ and $R^2$ are each a residue obtained by removing a hydroxy group from a saturated alcohol with 17 to 32 carbon atoms or a residue obtained by removing a hydroxy group from an alkylene oxide adduct of a saturated alcohol with 17 to 32 carbon atoms.)

Regarding the above carbon fiber precursor treatment agent, the lubricant preferably further contains a sulfur-containing monoester compound represented by Chemical Formula 2 shown below.

$$R^3\text{—OOC—}(CH_2)_c\text{—S—}(CH_2)_d\text{-COOH} \quad \text{[Chemical Formula 2]}$$

(In Chemical Formula 2, c and d are each an integer from 1 to 10 and $R^3$ is a residue obtained by removing a hydroxy group from a saturated alcohol with 17 to 32 carbon atoms or a residue obtained by removing a hydroxy group from an alkylene oxide adduct of a saturated alcohol with 17 to 32 carbon atoms.)

Regarding the above carbon fiber precursor treatment agent, a mass ratio of a content of the sulfur-containing diester compound and a content of the sulfur-containing monoester compound is preferably such that sulfur-containing diester compound/sulfur-containing monoester compound=99.999/0.001 to 80/20.

Regarding the above carbon fiber precursor treatment agent, at least one selected from among $R^1$ in the Chemical Formula 1, $R^2$ in the Chemical Formula 1, and $R^3$ in the Chemical Formula 2 is preferably a residue obtained by removing a hydroxy group from a saturated alcohol with 17 to 32 carbon atoms having a branched chain or a residue obtained by removing a hydroxy group from an alkylene oxide adduct of a saturated alcohol with 17 to 32 carbon atoms having a branched chain.

Regarding the above carbon fiber precursor treatment agent, at least one selected from among $R^1$ in the Chemical Formula 1, $R^2$ in the Chemical Formula 1, and $R^3$ in the Chemical Formula 2 is preferably a residue obtained by removing a hydroxy group from a saturated Guerbet alcohol with 17 to 32 carbon atoms or a residue obtained by removing a hydroxy group from an alkylene oxide adduct of a saturated Guerbet alcohol with 17 to 32 carbon atoms.

Regarding the above carbon fiber precursor treatment agent, at least one selected from among $R^1$ in the Chemical Formula 1, $R^2$ in the Chemical Formula 1, and $R^3$ in the Chemical Formula 2 preferably has 20 to 32 carbon atoms and more preferably has 24 to 32 carbon atoms.

Regarding the above carbon fiber precursor treatment agent, the lubricant preferably further contains a modified silicone having a modified group that includes a nitrogen atom.

Regarding the above carbon fiber precursor treatment agent, preferably, the lubricant further contains a modified silicone having a modified group that includes a nitrogen atom and, if the total content of the sulfur-containing diester compound, the sulfur-containing monoester compound, and the modified silicone is taken as 100% by mass, the sulfur-containing diester compound and the sulfur-containing monoester compound are contained at a ratio of 30% to 95% by mass in total.

Preferably, the above carbon fiber precursor treatment agent further contains a surfactant.

Preferably, the above carbon fiber precursor treatment agent further contains a surfactant, the lubricant further contains a modified silicone having a modified group that includes a nitrogen atom, and if the total content of the sulfur-containing diester compound, the sulfur-containing monoester compound, the modified silicone, and the surfactant is taken as 100% by mass, the carbon fiber precursor treatment agent contains the sulfur-containing diester compound and the sulfur-containing monoester compound at a ratio of 20% to 75% by mass in total.

An aqueous liquid of a carbon fiber precursor treatment agent for solving the above problem in gist contains the above carbon fiber precursor treatment agent and water.

A carbon fiber precursor for solving the above problem in gist has the above carbon fiber precursor treatment agent adhered thereto.

A method for producing a carbon fiber for solving the above problem in gist includes adhering the above carbon fiber precursor treatment agent to a carbon fiber precursor.

A method for producing a carbon fiber for solving the above problem in gist includes the following steps 1 to 3. Step 1: a yarn making step of making a yarn by adhering the above carbon fiber precursor treatment agent to a carbon fiber precursor. Step 2: a flame-resisting treatment step of converting the carbon fiber precursor obtained in the step 1 to flame-resistant fibers in an oxidizing atmosphere of 200° C. to 300° C. Step 3: a carbonization step of further carbonizing the flame-resistant fibers obtained in the step 2 in an inert atmosphere of 300° C. to 2,000° C. That is, the method includes a step of adhering the carbon fiber precursor treatment agent to a carbon fiber precursor to make a yarn, a step of converting the carbon fiber precursor with the carbon fiber precursor treatment agent adhered to flame-resistant fibers in an oxidizing atmosphere of 200° C. to 300° C., and a step of further carbonizing the flame-resistant fibers in an inert atmosphere of 300° C. to 2,000° C.

Effect of the Invention

The carbon fiber precursor treatment agent of the present invention succeeds in suitably improving a fusion suppression effect between fibers in a flame-resisting treatment step of a carbon fiber precursor and heat resistance.

BRIEF DESCRIPTION OF DRAWINGS

FIG. 1 is a schematic view of an apparatus for measuring smoothness.

MODES FOR CARRYING OUT THE INVENTION

First Embodiment

A first embodiment that embodies a carbon fiber precursor treatment agent according to the present invention (also referred to hereinafter simply as treatment agent) will now be described.

The treatment agent of the present embodiment contains a lubricant. The lubricant contains a sulfur-containing diester compound represented by Chemical Formula 3 shown below.

$$R^1\text{—OOC—}(CH_2)_a\text{—S—}(CH_2)_b\text{—COO—}R^2 \quad \text{[Chemical Formula 3]}$$

In Chemical Formula 3, a and b are each an integer from 1 to 10 and $R^1$ and $R^2$ are each a residue obtained by removing a hydroxy group from a saturated alcohol with 17 to 32 carbon atoms or a residue obtained by removing a hydroxy group from an alkylene oxide adduct of a saturated alcohol with 17 to 32 carbon atoms. a and b may be the same as or different from each other. $R^1$ and $R^2$ may be the same as or different from each other.

One type of such sulfur-containing diester compounds may be used alone or two or more types thereof may be used in combination.

The saturated alcohol may be a straight chain saturated alcohol or a saturated alcohol having a branched chain.

Specific examples of the straight chain saturated alcohol include heptadecanol, octadecanol, nonadecanol, eicosanol, heneicosanol, docosanol, tetracosanol, hexacosanol, heptacosanol, octacosanol, nonacosanol, triacontanol, and dotriacontanol.

Specific examples of the saturated alcohol having a branched chain include isoheptadecanol, isostearyl alcohol, isononadecanol, isoeicosanol, isodocosanol, isotetracosanol, isohexacosanol, isoheptacosanol, isooctacosanol, 2-octyldodecanol, 2-dodecylhexadecanol, 2-tetradecyloctadecanol, 2-decyltetradecanol, and 2-hexyl-1-dodecanol.

Specific examples of the alkylene oxide include ethylene oxide and propylene oxide. The added number of moles of the alkylene oxide is set as appropriate and is preferably 0.1 to 60 moles, more preferably 1 to 40 moles, and even more preferably 2 to 30 moles. The added number of moles of the alkylene oxide represents the number of moles of the alkylene oxide with respect to 1 mole of the alcohol in charged raw materials.

Specific examples of the sulfur-containing diester compound represented by Chemical Formula 3 above include a diester of 2-tetradecyloctadecanol and thiodipropionic acid, a diester of 3 mole ethylene oxide adduct of 2-tetradecyloctadecanol and thiodipropionic acid, a diester of 2-decyltetradecanol and thiodipropionic acid, a diester of 5 mole ethylene oxide adduct of 2-decyltetradecanol and thiodipropionic acid, a diester of 2-hexyl-1-dodecanol and thiodipropionic acid, a diester of 9-heptadecanol and thiodipropionic acid, and a diester of 1-octadecanol and thiodipropionic acid.

One type of the above sulfur-containing diester compounds may be used alone or two or more types thereof may be used in combination.

By containing the above sulfur-containing diester compound, heat resistance of the treatment agent can be improved. Also, a fusion suppression effect of the treatment agent can be improved.

Preferably, the lubricant also contains a sulfur-containing monoester compound represented by Chemical Formula 4 shown below.

$$R^3\text{—OOC—}(CH_2)_c\text{—S—}(CH_2)_d\text{—COOH} \quad \text{[Chemical Formula 4]}$$

In Chemical Formula 4, c and d are each an integer from 1 to 10 and $R^3$ is a residue obtained by removing a hydroxy group from a saturated alcohol with 17 to 32 carbon atoms or a residue obtained by removing a hydroxy group from an alkylene oxide adduct of a saturated alcohol with 17 to 32 carbon atoms. c and d may be the same as or different from each other.

One type of such sulfur-containing monoester compounds may be used alone or two or more types thereof may be used in combination.

The saturated alcohol may be a straight chain saturated alcohol or a saturated alcohol having a branched chain. Specific examples of the straight chain saturated alcohol or the saturated alcohol having a branched chain include those given as examples in Chemical Formula 3. Also, as specific examples of the alkylene oxide, those given as examples in Chemical Formula 3 can be cited. The same as described for Chemical Formula 3 can apply to the added number of moles of the alkylene oxide.

Specific examples of the sulfur-containing monoester compound represented by Chemical Formula 4 above include a monoester of 2-tetradecyloctadecanol and thiodipropionic acid, a monoester of 3 mole ethylene oxide adduct of 2-tetradecyloctadecanol and thiodipropionic acid, a monoester of 2-decyltetradecanol and thiodipropionic acid, a monoester of 5 mole ethylene oxide adduct of 2-decyltetradecanol and thiodipropionic acid, a monoester of 2-hexyl-1-dodecanol and thiodipropionic acid, a monoester of 9-heptadecanol and thiodipropionic acid, and a monoester of 1-octadecanol and thiodipropionic acid.

One type of the above sulfur-containing monoester compounds may be used alone or two or more types thereof may be used in combination.

By containing the above sulfur-containing monoester compound, smoothness can be improved further.

There is no restriction in a mass ratio of a content of the sulfur-containing diester compound and a content of the sulfur-containing monoester compound. The mass ratio of the content of the sulfur-containing diester compound and the content of the sulfur-containing monoester compound is preferably such that sulfur-containing diester compound/sulfur-containing monoester compound=99.999/0.001 to 80/20 and is more preferably 99.999/0.001 to 95/5. By specifying to be of such ratio, the treatment agent can be improved further in heat resistance.

Preferably with the lubricant, at least one selected from among $R^1$ in Chemical Formula 3, $R^2$ in Chemical Formula 3, and $R^3$ in Chemical Formula 4 above has 20 to 32 carbon atoms.

Preferably with the lubricant, at least one selected from among $R^1$ in Chemical Formula 3, $R^2$ in Chemical Formula 3, and $R^3$ in Chemical Formula 4 above is a residue obtained by removing a hydroxy group from a saturated alcohol with 17 to 32 carbon atoms having a branched chain or a residue obtained by removing a hydroxy group from an alkylene oxide adduct of a saturated alcohol with 17 to 32 carbon atoms having a branched chain.

Preferably with the lubricant, at least one selected from among $R^1$ in Chemical Formula 3, $R^2$ in Chemical Formula 3, and $R^3$ in Chemical Formula 4 above is a residue obtained by removing a hydroxy group from a saturated Guerbet alcohol with 17 to 32 carbon atoms or a residue obtained by removing a hydroxy group from an alkylene oxide adduct of a saturated Guerbet alcohol with 17 to 32 carbon atoms.

The carbon fiber precursor treatment agent preferably contains, as the lubricant, a modified silicone having a modified group that includes a nitrogen atom.

Specific examples of the modified silicone having a modified group that includes a nitrogen atom include amino-modified silicones, amide-modified silicones, and aminopolyether-modified silicones. One type of such modified silicones may be used alone or two or more types thereof may be used in combination.

There is no restriction in the contents of the sulfur-containing diester compound, the sulfur-containing monoester compound, and the modified silicone. If the total content of the sulfur-containing diester compound, the sulfur-containing monoester compound, and the modified silicone is taken as 100% by mass, the carbon fiber precursor treatment agent preferably contains the sulfur-containing diester compound and the sulfur-containing monoester compound at a ratio of 30% to 95% by mass in total. By specifying to be of such ratio, the effects of the present invention can be improved further.

Preferably, the carbon fiber precursor treatment agent further contains a surfactant.

Specific examples of the surfactant include anionic surfactants, cationic surfactants, and nonionic surfactants. One type of such surfactants may be used alone or two or more types thereof may be used in combination.

Specific examples of the anionic surfactants include (1) alkali metal salts of sulfuric acid esters of fatty acids with 8 to 24 carbon atoms, such as alkali metal salts of castor oil fatty acid sulfuric acid esters, alkali metal salts of sesame oil fatty acid sulfuric acid esters, alkali metal salts of tall oil fatty acid sulfuric acid esters, alkali metal salts of soybean oil fatty acid sulfuric acid esters, alkali metal salts of rapeseed oil fatty acid sulfuric acid esters, alkali metal salts of palm oil fatty acid sulfuric acid esters, alkali metal salts of lard fatty acid sulfuric acid esters, alkali metal salts of beef tallow fatty acid sulfuric acid esters, and alkali metal salts of whale oil fatty acid sulfuric acid esters, (2) alkali metal salts of sulfuric acid esters of aliphatic alcohols with 8 to 24 carbon atoms, such as alkali metal salts of lauryl sulfuric acid ester, alkali metal salts of cetyl sulfuric acid ester, alkali metal salts of oleyl sulfuric acid ester, and alkali metal salts of stearyl sulfuric acid ester, (3) alkali metal salts of sulfuric acid esters of compounds having a total of 1 to 20 moles (representing the average number of moles added) of an alkylene oxide with 2 to 4 carbon atoms added to an aliphatic alcohol with 8 to 24 carbon atoms, such as alkali metal salts of sulfuric acid ester of polyoxyethylene (with the number n of oxyethylene units being 3, that is, n=3) lauryl ether, alkali metal salts of sulfuric acid ester of polyoxyethylene (n=5) lauryl ether, alkali metal salts of sulfuric acid ester of polyoxyethylene (n=3) polyoxypropylene (with the number m of oxypropylene units being 3, that is, m=3) lauryl ether, alkali metal salts of sulfuric acid ester of polyoxy ethylene (n=3) oleyl ether, and alkali metal salts of sulfuric acid ester of polyoxyethylene (n=5) oleyl ether, (4) alkali metal salts of aliphatic alkyl phosphoric acid esters with 8 to 24 carbon atoms, such as alkali metal salts of lauryl phosphoric acid ester, alkali metal salts of cetyl phosphoric acid ester, alkali metal salts of oleyl phosphoric acid ester, and alkali metal salts of stearyl phosphoric acid ester, (5) alkali metal salts of aliphatic alkyl sulfonic acids with 8 to 24 carbon atoms, such as alkali metal salts of lauryl sulfonic acid ester, alkali metal salts of cetyl sulfonic acid ester, alkali metal salts of oleyl sulfonic acid ester, alkali metal salts of stearyl sulfonic acid ester, and alkali metal salts of tetradecane sulfonic acid ester, (6) alkali metal salts of phosphoric acid esters of compounds having a total of 1 to 20 moles (representing the average number of moles added) of an alkylene oxide with 2 to 4 carbon atoms added to an aliphatic alcohol, such as alkali metal salts of polyoxyethylene (n=5) lauryl ether phosphoric acid ester, alkali metal salts of polyoxyethylene (n=5) oleyl ether phosphoric acid ester, and alkali metal salts of polyoxyethylene (n=10) stearyl ether phosphoric acid ester, (7) sulfated oils, such as sulfuric acid esters of oils and fats including sulfuric acid ester of castor oil, sulfuric acid ester of sesame oil, sulfuric acid ester of tall oil, sulfuric acid ester of soybean oil, sulfuric acid ester of rapeseed oil, sulfuric acid ester of palm oil, sulfuric acid ester of lard, sulfuric acid ester of beef tallow, and sulfuric acid ester of whale oil, and amine salts thereof or alkali metal salts thereof, (8) alkali metal salts of fatty acids, such as alkali metal salts of lauric acid, alkali metal salts of oleic acid, and alkali metal salts of stearic acid, and (9) alkali metal salts of sulfosuccinic acid esters of aliphatic alcohols, such as alkali metal salts of dioctyl sulfosuccinic acid.

Specific examples of the alkali metal salts that constitute the anion surfactants mentioned above include sodium salts and potassium salts. Specific examples of the amine salts that constitute the anion surfactants mentioned above include (1) aliphatic amines, such as methylamine, dimethylamine, trimethylamine, ethylamine, diethylamine, triethylamine, N-N-diisopropylethylamine, butylamine, dibutylamine, 2-methylbutylamine, tributylamine, octylamine, and dimethyllaurylamine, (2) aromatic amines or heterocyclic amines, such as aniline, N-methylbenzylamine, pyridine, morpholine, piperazine, and derivatives thereof, (3) alkanolamines, such as monoethanolamine, N-methylethanolamine, diethanolamine, triethanolamine, isopropanolamine, diisopropanolamine, triisopropanolamine, dibutylethanolamine, butyldiethanolamine, octyldiethanolamine, and lauryldiethanolamine, (4) aryl amines, such as N-methylbenzylamine, (5) polyoxyalkylene alkyl aminoethers, such as polyoxyethylene lauryl aminoethers and polyoxyethylene stearyl aminoethers, and (6) ammonia.

Specific examples of the cationic surfactants include lauryltrimethylammonium chloride, cetyltrimethylammonium chloride, stearyltrimethylammonium chloride, behenyltrimethylammonium chloride, and didecyldimethylammonium chloride.

Examples of the nonionic surfactants include compounds in which an alkylene oxide is added to an alcohol or a carboxylic acid, ester compounds of a carboxylic acid and a polyhydric alcohol, and ether/ester compounds in which an alkylene oxide is added to an ester compound of a carboxylic acid and a polyhydric alcohol.

Specific examples of the alcohol used as a raw material of the nonionic surfactant include (1) straight-chain alkyl alcohols, such as methanol, ethanol, propanol, butanol, pentanol, hexanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol, and triacontanol, (2) branched alkyl alcohols, such as isopropanol, isobutanol, isohexanol, 2-ethylhexanol, isononanol, isodecanol, isododecanol, isotridecanol, isotetradecanol, isotriacontanol, isohexadecanol, isoheptadecanol, isooctadecanol, isononadecanol, isoeicosanol, isoheneicosanol, isodocosanol, isotricosanol, isotetracosanol, isopentacosanol, isohexacosanol, isoheptacosanol, isooctacosanol, isononacosanol, and isopentadecanol, (3) straight-chain alkenyl alcohols, such as tetradecenol, hexadecenol, heptadecenol, octadecenol, and nonadecenol, (4) branched alkenyl alcohols, such as isohexadecenol and isooctadecenol, (5) cyclic alkyl alcohols, such as cyclopentanol and cyclohexanol, (6) aromatic alcohols, such as phenol, benzyl alcohol, monostyrenated phenol, distyrenated phenol, and tristyrenated phenol.

Specific examples of the carboxylic acid used as a raw material of the nonionic surfactant include (1) straight-chain alkyl carboxylic acids, such as octylic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, and docosanoic acid, (2) branched alkyl carboxylic acids, such as 2-ethylhexanoic acid, isododecanoic acid, isotridecanoic acid, isotetradecanoic acid, isohexadecanoic acid, and isooctadecanoic acid, (3) straight-chain alkenyl carboxylic acids, such as octadecenoic acid, octadecadienoic acid, and octadecatrienoic acid, and (4) aromatic-based carboxylic acid, such as benzoic acid.

Specific examples of the alkylene oxide used as a raw material of the nonionic surfactant include ethylene oxide and propylene oxide. The added number of moles of alkylene oxide is set as appropriate and is preferably 0.1 to 60 moles, more preferably 1 to 40 moles, and even more preferably 2 to 30 moles. The added number of moles of alkylene oxide represents the number of moles of the alkylene oxide with respect to 1 mole of the alcohol or the carboxylic acid in the charged raw materials.

Specific examples of the polyhydric alcohol used as a raw material of the nonionic surfactant include ethylene glycol, propylene glycol, 1,3-propanediol, 1,2-butanediol, 1,3-butanediol, 1,4-butanediol, 1,4-butanediol, 2-methyl-1,2-propanediol, 1,5-pentanediol, 1,6-hexanediol, 2,5-hexanediol, 2-methyl-2,4-pentanediol, 2,3-dimethyl-2,3-butanediol, glycerin, 2-methyl-2-hydroxymethyl-1,3-propanediol, 2-ethyl-2-hydroxymethyl-1,3-propanediol, trimethylolpropane, sorbitan, pentaerythritol, and sorbitol.

Specific examples of the nonionic surfactant include an 8 mole ethylene oxide and 17 mole propylene oxide adduct of isotetradecyl alcohol, a 20 mole ethylene oxide adduct of dodecyl alcohol, and a 10 mole ethylene oxide and 8 mole propionic oxide adduct of nonyl alcohol.

There is no restriction in the contents of the sulfur-containing diester compound, the sulfur-containing monoester compound, the modified silicone, and the surfactant. If the total content of the sulfur-containing diester compound, the sulfur-containing monoester compound, the modified silicone, and the surfactant is taken as 100% by mass, the carbon fiber precursor treatment agent preferably contains the sulfur-containing diester compound and the sulfur-containing monoester compound at a ratio of 20% to 75% by mass in total. By specifying to be of such ratio, the treatment agent can be improved further in heat resistance.

Second Embodiment

A second embodiment that embodies an aqueous liquid of a carbon fiber precursor treatment agent according to the present invention (also referred to hereinafter simply as aqueous liquid) will now be described.

The aqueous liquid of the present embodiment contains the treatment agent of the first embodiment and water. There is no restriction in a content of the treatment agent in the aqueous liquid. The content of the treatment agent in the aqueous liquid is preferably 0.01% to 99.9% by mass and more preferably 0.1% to 50% by mass. By specifying to be of such ratio, the aqueous liquid can be improved in handling property and improved in temporal stability.

Third Embodiment

A third embodiment that embodies a carbon fiber precursor (also referred to hereinafter simply as precursor) will now be described. The precursor of the present embodiment has the treatment agent of the first embodiment adhered thereto. Example of the precursor include fibers made of resin that become carbon fibers by undergoing a carbonization step to be described below. The resin that constitutes the precursor is not restricted in particular and example thereof include acrylic resin, polyethylene resin, phenol resin, and pitch.

A ratio at which the treatment agent of the first embodiment is adhered to the carbon fiber precursor is not restricted in particular and the treatment agent (not containing a solvent) is preferably adhered such as to be 0.1% to 2% by mass and more preferably adhered such as to be 0.3% to 1.2% by mass with respect to the carbon fiber precursor.

Fourth Embodiment

A fourth embodiment that embodies a method for producing a carbon fiber according to the present invention will now be described. The method for producing a carbon fiber of the present embodiment includes adhering the treatment agent of the first embodiment to a precursor. The form of the treatment agent of the first embodiment when adhering the treatment agent to fibers may be, for example, an organic solvent solution or an aqueous liquid. The method for adhering the treatment agent of the first embodiment to the precursor may be a method of using, for example, the aqueous liquid of the second embodiment or a further diluted aqueous solution to adhere by a known method such as an immersion method, a spraying method, a roller method, or a guide oiling method using a metering pump.

The method for producing a carbon fiber of the present embodiment preferably includes the following steps 1 to 3.

Step 1: a yarn making step of making a yarn by adhering the treatment agent of the first embodiment to a precursor.

Step 2: a flame-resisting treatment step of converting the precursor obtained in step 1 to a flame-resistant fiber in an oxidizing atmosphere of 200° C. to 300° C. and preferably 230° C. to 270° C.

Step 3: a carbonization step of carbonizing the flame-resistant fiber obtained in the step 2 in an inert atmosphere of 300° C. to 2,000° C. and preferably 300° C. to 1,300° C.

The yarn making step preferably further includes a spinning step of spinning a resin into fibers, a dry densification step of drying and densifying the spun fibers, and a drawing step of drawing the dry densified fibers.

Although a temperature of the dry densification step is not restricted in particular, the fibers that have undergone the spinning step are preferably heated, for example, at 70° C. to 200° C. Although a timing at which the treatment agent is adhered to the precursor is not restricted in particular, it is preferably between the spinning step and the dry densification step.

The oxidizing atmosphere in the flame-resisting treatment step is not restricted in particular and may be, for example, an air atmosphere.

The inert atmosphere in the carbonization step is not restricted in particular and may be, for example, a nitrogen atmosphere, an argon atmosphere, or a vacuum atmosphere.

The following effects can be obtained by the treatment agent, the aqueous liquid, the precursor, and the method for producing a carbon fiber of the embodiments.

(1) The treatment agent of the embodiments contains a specific sulfur-containing diester compound. Therefore, the heat resistance of the treatment agent can be improved. Also, the effect of suppressing fusion (fusion suppression effect) between fibers in the flame-resisting treatment step of the carbon fiber precursor can be improved.

(2) The treatment agent is adhered to the carbon fiber precursor between the spinning step and the dry densification step. Since it is possible to improve a bundling property of the carbon fiber precursor that has undergone the dry densification step and the drawing step and improve a bundling property of the flame-resistant fibers that have undergone the flame-resisting treatment step, winding of fibers and forming of fluff during a production process of carbon fibers can be suppressed. Therefore, carbon fibers can be made satisfactory in appearance and strength of the carbon fibers can be improved.

(3) Smoothness of a fiber bundle that constitutes the carbon fiber precursor can be improved. Since it is possible to suppress winding of the fiber bundle around a roller during the production process of carbon fibers, the production of carbon fibers can be performed efficiently.

The above-described embodiments can be modified as follows. The above-described embodiments and the following modifications can be implemented upon being combined with each other within a range that is not technically inconsistent.

- Although in the embodiments, the treatment agent is adhered to the precursor between the spinning step and the dry densification step, there is no restriction to this mode. The treatment agent may be adhered to the precursor between the dry densification step and the drawing step or the treatment agent may be adhered to the precursor between the drawing step and the flame-resisting treatment step.
- Although in the embodiments, the carbon fiber precursor treatment agent contains a modified silicone and a surfactant, there is no restriction to this mode. At least one of either of the modified silicone and the surfactant may be omitted.
- Stabilizers, antistatic agents, electrostatic preventing agents, binders, antioxidants, ultraviolet absorbers, and other ingredients that are ordinarily used in the treatment agent or the aqueous liquid for quality maintenance of the treatment agent or the aqueous liquid may further be blended in the treatment agent or the aqueous liquid of the embodiments within a range that does not impair the effects of the present invention.

EXAMPLES

Examples will now be given below to describe the feature and effects of the present invention more specifically, but the present invention is not restricted to these examples. In the following description of working examples and comparative examples, % means % by mass.

Experimental Part 1 (Preparation of Carbon Fiber Precursor Treatment Agents)

Example 1

The respective ingredients shown in Table 1 were used and added to a beaker such that blending ratios are 29.97% of a sulfur-containing ester compound (A-1a), 0.03% of a sulfur-containing ester compound (A-1b), 45% of a modified silicone (C-1), and 25% of a surfactant (L-1). These were mixed well by stirring. While continuing to stir, ion exchanged water was added gradually to achieve a solids concentration of 25% and thereby prepare a 25% aqueous liquid of a carbon fiber precursor treatment agent of Example 1.

Examples 2 to 23 and Comparative Examples 1 to 6

Respective carbon fiber precursor treatment agents of Examples 2 to 23 and Comparative Examples 1 to 6 were prepared using the respective ingredients shown in Table 1 and in accordance with the same procedure as Example 1.

The type and content of the lubricant and the type and content of the surfactant in the treatment agent of each example are as respectively indicated in the "Lubricant"

column and the "Surfactant" column of Table 1. A mass ratio of the content of the sulfur-containing diester compound and the content of the sulfur-containing monoester compound in each lubricant is indicated in the "Mass ratio of sulfur-containing diester compound and sulfur-containing monoester compound" column of Table 1. The content of the sulfur-containing diester compound and the sulfur-containing monoester compound in total when the total content of the sulfur-containing diester compound, the sulfur-containing monoester compound, and the modified silicone is taken as 100% by mass is indicated in the "Percentage of lubricant" column of Table 1.

TABLE 1

| | Carbon fiber precursor treatment agent | | | | | | | | | | | |
|---|---|---|---|---|---|---|---|---|---|---|---|---|
| | Lubricant | | | | | | | | | | | |
| | Sulfur-containing ester compounds | | | Modified silicone | | Percentage of lubricant (Sulfur-containing ester compounds)/(Sulfur-containing diester compound + modified silicone) | Surfactant | | Evaluation results | | | |
| | Symbol | Percentage (% by mass) | Mass ratio of sulfur-containing diester compound and sulfur-containing monoester compound | Symbol | Percentage (% by mass) | | Symbol | Percentage (% by mass) | Heat resistance | Fiber fusion | Bundling property | Smoothness |
| Example 1 | A-1a<br>A-1b | 29.97<br>0.03 | 99.9/0.1 | C-1 | 45 | 40 | L-1 | 25 | 5 | 5 | 5 | 5 |
| Example 2 | A-1c<br>A-1d | 29.97<br>0.03 | 99.9/0.1 | C-1 | 45 | 40 | L-1 | 25 | 5 | 5 | 5 | 5 |
| Example 3 | A-1a<br>A-1b | 29.97<br>0.03 | 99.9/0.1 | C-2 | 45 | 40 | L-1 | 25 | 5 | 5 | 5 | 5 |
| Example 4 | A-1a<br>A-1b | 29.97<br>0.03 | 99.9/0.1 | C-1 | 45 | 40 | L-2 | 25 | 5 | 5 | 5 | 5 |
| Example 5 | A-1a<br>A-1b | 27<br>3 | 90/10 | C-1 | 45 | 40 | L-1 | 25 | 5 | 5 | 5 | 5 |
| Example 6 | A-1a<br>A-1b | 24<br>6 | 80/20 | C-1 | 45 | 40 | L-1 | 25 | 5 | 5 | 5 | 5 |
| Example 7 | A-2a<br>A-2b | 29.997<br>0.003 | 99.99/0.01 | C-1 | 45 | 40 | L-1 | 25 | 5 | 5 | 5 | 5 |
| Example 8 | A-2a<br>A-2b | 29.997<br>0.003 | 99.99/0.01 | C-1 | 55 | 35.3 | L-1 | 15 | 5 | 5 | 5 | 5 |
| Example 9 | A-2a<br>A-2b | 29.997<br>0.003 | 99.99/0.01 | C-1 | 35 | 46.2 | L-1 | 35 | 5 | 5 | 5 | 5 |
| Example 10 | A-2c<br>A-2d | 29.997<br>0.003 | 99.99/0.01 | C-1 | 45 | 40 | L-1 | 25 | 5 | 5 | 5 | 5 |
| Example 11 | A-2a<br>A-2b | 29.997<br>0.003 | 99.99/0.01 | C-2 | 45 | 40 | L-1 | 25 | 5 | 5 | 5 | 5 |
| Example 12 | A-2a<br>A-2b | 29.997<br>0.003 | 99.99/0.01 | C-1 | 45 | 40 | L-3 | 25 | 5 | 5 | 5 | 5 |
| Example 13 | A-2a<br>A-2b | 27<br>3 | 90/10 | C-1 | 45 | 40 | L-1 | 25 | 5 | 5 | 5 | 5 |
| Example 14 | A-2a<br>A-2b | 24<br>6 | 80/20 | C-1 | 45 | 40 | L-1 | 25 | 5 | 5 | 5 | 5 |
| Example 15 | A-2a<br>A-2b | 20.7<br>2.3 | 90/10 | C-1 | 52 | 30.7 | L-1 | 25 | 5 | 5 | 5 | 5 |
| Example 16 | A-2a<br>A-2b | 62.1<br>6.9 | 90/10 | C-1 | 6 | 92.0 | L-1 | 25 | 5 | 5 | 5 | 5 |
| Example 17 | A-2a<br>A-2b | 30<br>0 | 100/0 | C-1 | 45 | 40 | L-1 | 25 | 5 | 5 | 5 | 4 |
| Example 18 | A-2a<br>A-2b | 12<br>18 | 40/60 | C-1 | 45 | 40 | L-1 | 25 | 4 | 5 | 5 | 5 |
| Example 19 | A-3a<br>A-3b | 29.97<br>0.03 | 99.9/0.1 | C-1 | 45 | 40 | L-1 | 25 | 4 | 5 | 5 | 5 |
| Example 20 | A-2a<br>A-2b | 67.5<br>7.5 | 90/10 | — | 0 | 100 | L-1 | 25 | 4 | 5 | 5 | 4 |
| Example 21 | A-2a<br>A-2b | 13.5<br>1.5 | 90/10 | C-1 | 60 | 20 | L-2 | 25 | 5 | 4 | 4 | 5 |
| Example 22 | A-4a<br>A-4b | 29.97<br>0.03 | 99.9/0.1 | C-1 | 45 | 40 | L-1 | 25 | 4 | 5 | 4 | 5 |
| Example 23 | A-5a<br>A-5b | 29.97<br>0.03 | 99.9/0.1 | C-1 | 45 | 40 | L-1 | 25 | 4 | 4 | 4 | 5 |
| Comparative Example 1 | — | 0 | — | C-1 | 70 | 0 | L-1 | 30 | 3 | 2 | 1 | 4 |
| Comparative Example 2 | — | 0 | — | C-2 | 70 | 0 | L-1 | 30 | 3 | 2 | 1 | 4 |

TABLE 1-continued

| | Carbon fiber precursor treatment agent | | | | | | | | | | | |
|---|---|---|---|---|---|---|---|---|---|---|---|---|
| | Lubricant | | | | | | | | | | | |
| | Sulfur-containing ester compounds | | | Modified silicone | | | Surfactant | | | | | |
| | Symbol | Percentage (% by mass) | Mass ratio of sulfur-containing diester compound and sulfur-containing monoester compound | Symbol | Percentage (% by mass) | Percentage of lubricant (Sulfur-containing ester compounds)/(Sulfur-containing diester compound + modified silicone) | Symbol | Percentage (% by mass) | Evaluation results: Heat resistance | Fiber fusion | Bundling property | Smoothness |
| Comparative Example 3 | rA-6a<br>rA-6b | 29.97<br>0.03 | 99.9/0.1 | C-1 | 35 | 46.2 | L-1 | 35 | 1 | 4 | 2 | 2 |
| Comparative Example 4 | rA-7a<br>rA-7b | 29.97<br>0.03 | 99.9/0.1 | C-1 | 35 | 46.2 | L-1 | 35 | 1 | 4 | 2 | 2 |
| Comparative Example 5 | rA-8a<br>rA-8b | 29.97<br>0.03 | 99.9/0.1 | C-1 | 35 | 46.2 | L-1 | 35 | 1 | 1 | 1 | 1 |
| Comparative Example 6 | A-2a<br>A-2b | 0<br>30 | 0/100 | C-1 | 35 | 46.2 | L-1 | 35 | 1 | 1 | 1 | 1 |

Details of the respective ingredients A-1a to A-5b, rA-6a to rA-8b, C-1 to C-2, and L-1 to L-3 indicated in the symbol columns of Table 1 are as follows.

(Sulfur-Containing Ester Compounds)

A-1a: diester of 2-tetradecyloctadecanol and thiodipropionic acid

A-1b: monoester of 2-tetradecyloctadecanol and thiodipropionic acid

A-1c: diester of 3 mole ethylene oxide adduct of 2-tetradecyloctadecanol and thiodipropionic acid A-1d: monoester of 3 mole ethylene oxide adduct of 2-tetradecyloctadecanol and thiodipropionic acid A-2a: diester of 2-decyltetradecanol and thiodipropionic acid A-2b: monoester of 2-decyltetradecanol and thiodipropionic acid A-2c: diester of 5 mole ethylene oxide adduct of 2-decyltetradecanol and thiodipropionic acid A-2d: monoester of 5 mole ethylene oxide adduct of 2-decyltetradecanol and thiodipropionic acid A-3a: diester of 2-hexyl-1-dodecanol and thiodipropionic acid A-3b: monoester of 2-hexyl-1-dodecanol and thiodipropionic acid A-4a: diester of 9-heptadecanol and thiodipropionic acid A-4b: monoester of 9-heptadecanol and thiodipropionic acid A-5a: diester of 1-octadecanol and thiodipropionic acid A-5b: monoester of 1-octadecanol and thiodipropionic acid rA-6a: diester of 2-hexyldecanol and thiodipropionic acid rA-6b: monoester of 2-hexyldecanol and thiodipropionic acid rA-7a: diester of oleyl alcohol and thiodipropionic acid rA-7b: monoester of oleyl alcohol and thiodipropionic acid rA-8a: diester of 2-decyltetradecanol and adipic acid rA-8b: monoester of 2-decyltetradecanol and adipic acid The presence or non-presence of sulfur atom, the number of carbon atoms, saturated or unsaturated state, branched or straight chain configuration, and branch position of the above sulfur-containing ester compounds are indicated in Table 2.

TABLE 2

| Symbol | Type of sulfur-containing ester compound | Presence/non-presence of sulfur atom | Number of carbon atoms | Saturated/unsaturated | Branched/straight chain | Branch position |
|---|---|---|---|---|---|---|
| A-1a | Diester of 2-tetradecyloctadecanol and thiodipropionic acid | Present | 32 | Saturated | Branched | β carbon |
| A-1b | Monoester of 2-tetradecyloctadecanol and thiodipropionic acid | Present | 32 | Saturated | Branched | β carbon |
| A-1c | Diester of 3 mole ethylene oxide adduct of 2-tetradecyloctadecanol and thiodipropionic acid | Present | 32 | Saturated | Branched | β carbon |
| A-1d | Monoester of 3 mole ethylene oxide adduct of 2-tetradecyloctadecanol and thiodipropionic acid | Present | 32 | Saturated | Branched | β carbon |
| A-2a | Diester of 2-decyltetradecanol and thiodipropionic acid | Present | 24 | Saturated | Branched | β carbon |

TABLE 2-continued

| Symbol | Type of sulfur-containing ester compound | Presence/ non-presence of sulfur atom | Number of carbon atoms | Saturated/ unsaturated | Branched/ straight chain | Branch position |
|---|---|---|---|---|---|---|
| A-2b | Monoester of 2-decyltetradecanol and thiodipropionic acid | Present | 24 | Saturated | Branched | β carbon |
| A-2c | Diester of 5 mole ethylene oxide adduct of 2-decyltetradecanol and thiodipropionic acid | Present | 24 | Saturated | Branched | β carbon |
| A-2d | Monoester of 5 mole ethylene oxide adduct of 2-decyltetradecanol and thiodipropionic acid | Present | 24 | Saturated | Branched | β carbon |
| A-3a | Diester of 2-hexyl-1-dodecanol and thiodipropionic acid | Present | 18 | Saturated | Branched | β carbon |
| A-3b | Monoester of 2-hexyl-l-dodecanol and thiodipropionic acid | Present | 18 | Saturated | Branched | β carbon |
| A-4a | Diester of 9-heptadecanol and thiodipropionic acid | Present | 17 | Saturated | Branched | α carbon |
| A-4b | Monoester of 9-heptadecanol and thiodipropionic acid | Present | 17 | Saturated | Branched | α carbon |
| A-5a | Diester of 1-octadecanol and thiodipropionic acid | Present | 18 | Saturated | Straight chain | — |
| A-5b | Monoester of 1-octadecanol and thiodipropionic acid | Present | 18 | Saturated | Straight chain | — |
| rA-6a | Diester of 2-hexyldecanol and thiodipropionic acid | Present | 16 | Saturated | Branched | β carbon |
| rA-6b | Monoester of 2-hexyldecanol and thiodipropionic acid | Present | 16 | Saturated | Branched | β carbon |
| rA-7a | Diester of oleyl alcohol and thiodipropionic acid | Present | 18 | Unsaturated | Straight chain | — |
| rA-7b | Monoester of oleyl alcohol and thiodipropionic acid | Present | 18 | Unsaturated | Straight chain | — |
| rA-8a | Diester of 2-decyltetradecanol and adipic acid | Not present | 24 | Saturated | Branched | β carbon |
| rA-8b | Monoester of 2-decyltetradecanol and adipic acid | Not present | 24 | Saturated | Branched | β carbon |

(Modified Silicones)

C-1: diamine type amino-modified silicone with viscosity of 90 $mm^2$ and amino equivalent of 4,000 g/mol.

C-2: diamine type amino-modified silicone with viscosity of 1,000 $mm^2$ and amino equivalent of 2,800 g/mol.

(Surfactants)

L-1: 8 mole ethylene oxide and 17 mole propylene oxide adduct of isotetradecyl alcohol L-2: 20 mole ethylene oxide adduct of dodecyl alcohol L-3: 10 mole ethylene oxide and 8 mole propylene oxide adduct of nonyl alcohol

Experimental Part 2 (Production of Carbon Fiber Precursors and Carbon Fibers)

Carbon fiber precursors and carbon fibers were produced using the carbon fiber precursor treatment agents prepared in Experimental Part 1.

First, as step 1, an acrylic resin that is a carbon fiber precursor was wet spun. Specifically, a copolymer of 1.80 limiting viscosity constituted of 95% by mass acrylonitrile, 3.5% by mass methyl acrylate, and 1.5% by mass methacrylic acid was dissolved in dimethylacetamide (DMAC) to prepare a spinning dope with a polymer concentration of 21.0% by mass and a viscosity at 60° C. of 500 poise. The spinning dope was discharged at a draft ratio of 0.8 from a spinneret with 12,000 holes of 0.075 mm hole diameter (inner diameter) into a coagulation bath of a 70% by mass aqueous solution of DMAC maintained at a spinning bath temperature of 35° C.

The coagulated yarn was drawn by 5 times at the same time as being desolvated in a rinse tank to prepare acrylic fiber strands (raw material fibers) in a water-swollen state. To these acrylic fiber strands, the carbon fiber precursor treatment agents prepared in Experimental Part 1 were each applied such that a solids adhesion amount would be 1% by mass (not including the solvent). Application of each carbon fiber precursor treatment agent was performed by an immersion method using a 4% ion exchanged water solution of the carbon fiber precursor treatment agent prepared by further diluting the aqueous liquid of each of the above examples with ion exchanged water. Thereafter, the acrylic fiber strands were subject to dry densification by a heating roller set at 130° C., further subject to drawing by 1.7 times between heating rollers set at 170° C., and thereafter wound around a spool using a winding device.

Next, as step 2, yarns were unwound from the wound carbon fiber precursor and, after being subject to flame-resisting treatment for 1 hour under an air atmosphere in a flame-resisting treatment furnace having a temperature gradient of 230° C. to 270° C., were wound around a spool to obtain flame-resistant yarns (flame-resistant fibers).

Next, as step 3, yarns were unwound from the wound flame-resistant yarns and, after conversion to carbon fibers by baking under a nitrogen atmosphere in a carbonizing furnace having a temperature gradient of 300° C. to 1,300° C., were wound around a spool to obtain the carbon fibers.

Experimental Part 3 (Evaluation)

Regarding each of the treatment agents of Examples 1 to 23 and Comparative Examples 1 to 6, heat resistance of the treatment agent, fiber fusion of the flame-resistant fibers, fiber bundling property of the precursor with the treatment agent adhered, and smoothness of the precursor with the treatment agent adhered were evaluated. Procedures of the respective tests are described below. The test results are shown in the "Heat resistance," "Fiber fusion," "Bundling property," and "Smoothness" columns of Table 1.

(Heat Resistance)

Each treatment agent was heated for 2 hours at 240° C. and weights before and after heating were measured. A residue rate was calculated based on the following calculation formula and evaluated based on the following criteria.

Residue rate Z (%)=(Weight of treatment agent after heating)/(Weight of treatment agent before heating)×100

Evaluation criteria for heat resistance

5: Z is not less than 80%.

4: Z is not less than 60% but less than 80%.

3: Z is not less than 40% but less than 60%.

2: Z is not less than 20% but less than 40%.

1: Z is less than 20%.

(Fiber Fusion)

From the flame-resistant fiber that has undergone the flame-resisting treatment step described above, 10 locations were selected at random, short fibers of approximately 1 cm length were cut out, and presence/non-presence of fusion was observed visually. The fusion state was evaluated based on the following criteria.

Evaluation criteria for fiber fusion

5: There is no fusion.

4: There is fusion at 1 to 2 locations.

3: There is fusion at 3 to 5 locations.

2: There is fusion at 6 to 7 locations.

1: There is fusion at 8 or more locations.

(Bundling Property)

With the precursor that has undergone the drawing step described above, conditions of bundling of the fiber bundle constituting the precursor were observed visually and the bundling property was evaluated based on the following criteria.

5: There are no split yarns and all yarns passed through the heating rollers and were wound up smoothly.

4: Although there are some split yarns, the yarns passed through the heating rollers and were wound up smoothly.

3: Although a portion of the single filaments became wound around the heating rollers, a large portion of the single filaments passed through the heating rollers and were wound up.

2: Single filaments became wound around the heating rollers and split yarns were seen before being wound up.

1: Single filaments became wound around the heating rollers, split yarns were seen before being wound up, and obstruction to production was seen.

(Smoothness)

As a device for measuring smoothness, Autograph ABS-1kNX (tensile tester) manufactured by Shimadzu Corporation was used.

As shown in FIG. 1, the fiber of the precursor with the treatment agent adhered (also referred to hereinafter as test yarn 1) was fixed at one end to a gripping tool 2 of the autograph and successively passed along a free roller 3, a chrome-plated textured pin 4, and a free roller 5 and a weight 6 of 50 g was fixed to the other end of the test yarn 1. A drive shaft 4*a* that the test yarn 1 contacts at the chrome-plated textured pin 4 is 1 cm in diameter and 2S in surface roughness. An angle formed by a direction in which the test yarn 1 extends between the chrome-plated textured pin 4 and the free roller 5 with respect to a direction in which the test yarn 1 extends between the free roller 3 and the chrome-plated textured pin 4 was set to 90°. In this state and under conditions of 25° C. and 60% RH, the drive shaft 4*a* of the chrome-plated textured pin 4 was put in a state of being rotated at a speed of 100 m/minute circumferential speed in a direction in which tension is applied to the autograph and the tension was measured by the autograph every 0.1 seconds for 30 seconds. An average value (N) of the tension during this time was determined and evaluated based on the following criteria.

5: The average value of tension is less than 2N.

4: The average value of tension is less than 3N but not less than 2N.

3: The average value of tension is less than 4N but not less than 3N.

2: The average value of tension is less than 5N but not less than 4N.

1: The average value of tension is not less than 5N.

Based on the results of Table 1, the present invention succeeds in improving the heat resistance of the carbon fiber precursor treatment agent. In addition, the fusion suppression effect between fibers can be improved. The bundling property and the smoothness of the fiber bundle that constitutes the carbon fiber precursor can also be improved.

The invention claimed is:

1. A carbon fiber precursor treatment agent comprising a lubricant, wherein the lubricant contains a modified silicone having a modified group that includes a nitrogen atom, a sulfur-containing diester compound represented by Formula I shown below:

$$R^1—OOC—(CH_2)_a—S—(CH_2)_b—COO—R^2 \quad [1]$$

wherein a and b are each an integer from 1 to 10, and $R^1$ and $R^2$ are each a residue obtained by removing a hydroxy group from a saturated alcohol with 17 to 32 carbon atoms or a residue obtained by removing a hydroxy group from an alkylene oxide adduct of a saturated alcohol with 17 to 32 carbon atoms, and a sulfur-containing monoester compound represented by Formula 2 Formula II shown below:

$$R^1—OOC—(CH_2)_a—S—(CH_2)_b—COO—R^2 \quad [2]$$

wherein c and d are each an integer from 1 to 10, and $R^3$ is a residue obtained by removing a hydroxy group from a saturated alcohol with 17 to 32 carbon atoms or a residue obtained by removing a hydroxy group from an alkylene oxide adduct of a saturated alcohol with 17 to 32 carbon atoms.

2. The carbon fiber precursor treatment agent according to claim 1, wherein a mass ratio of a content of the sulfur-containing diester compound of Formula I and a content of the sulfur-containing monoester compound of Formula II is 99.999/0.001 to 80/20.

3. The carbon fiber precursor treatment agent according to claim 1, wherein at least one selected from among $R^1$ in the Formula I, the $R^2$ in the Formula I, and the $R^3$ in the Formula II is a residue obtained by removing a hydroxy group from a saturated alcohol with 17 to 32 carbon atoms having a branched chain or a residue obtained by removing a hydroxy group from an alkylene oxide adduct of a saturated alcohol with 17 to 32 carbon atoms having a branched chain.

4. The carbon fiber precursor treatment agent according to claim 1, wherein at least one selected from among $R^1$ in the Formula I, $R^2$ in the Formula I, and $R^3$ in the Formula 2Formula II is a residue obtained by removing a hydroxy group from a saturated Guerbet alcohol with 17 to 32 carbon atoms or a residue obtained by removing a hydroxy group from an alkylene oxide adduct of a saturated Guerbet alcohol with 17 to 32 carbon atoms.

5. The carbon fiber precursor treatment agent according to claim 1, wherein at least one selected from among $R^1$ in the Formula I, $R^2$ in the Formula I, and $R^3$ in the Formula II has 24 to 32 carbon atoms.

6. The carbon fiber precursor treatment agent according to claim 1, wherein if a total content of the sulfur-containing diester compound, the sulfur-containing monoester compound, and the modified silicone is taken as 100% by mass, the sulfur-containing diester compound and the sulfur-containing monoester compound are contained at a ratio of 30% to 95% by mass in total.

7. The carbon fiber precursor treatment agent according to claim 1, further containing a surfactant.

8. The carbon fiber precursor treatment agent according to claim 1, further containing a surfactant, and wherein the lubricant further contains a modified silicone having a modified group that includes a nitrogen atom, and if a total content of the sulfur-containing diester compound, the sulfur-containing monoester compound, the modified silicone, and the surfactant is taken as 100% by mass, the sulfur-containing diester compound and the sulfur-containing monoester compound are contained at a ratio of 20% to 75% by mass in total.

9. An aqueous liquid of a carbon fiber precursor treatment agent, comprising the carbon fiber precursor treatment agent according to claim 1 and water.

10. A carbon fiber precursor to which the carbon fiber precursor treatment agent according to claim 1 is adhered.

11. A method for producing a carbon fiber, comprising adhering the carbon fiber precursor treatment agent according to claim 1 to a carbon fiber precursor.

12. A method for producing a carbon fiber, comprising making a yarn by adhering the carbon fiber precursor treatment agent according to claim 1 to a carbon fiber precursor;

converting the carbon fiber precursor to a flame-resistant fiber in an oxidizing atmosphere of 200° C. to 300° C.; and carbonizing the flame-resistant fiber in an inert atmosphere of 300° C. to 2,000° C.

* * * * *